US009200480B2

(12) United States Patent
Deiler

(10) Patent No.: US 9,200,480 B2
(45) Date of Patent: Dec. 1, 2015

(54) BULLET RESISTANT SECURITY DOOR

(71) Applicant: Alan P Deiler, Marshfield, WI (US)

(72) Inventor: Alan P Deiler, Marshfield, WI (US)

( * ) Notice: Subject to any disclaimer, the term of this patent is extended or adjusted under 35 U.S.C. 154(b) by 0 days.

(21) Appl. No.: 14/295,734

(22) Filed: Jun. 4, 2014

(65) Prior Publication Data

US 2014/0360416 A1 Dec. 11, 2014

Related U.S. Application Data

(60) Provisional application No. 61/956,551, filed on Jun. 11, 2013.

(51) Int. Cl.
*E05G 1/026* (2006.01)
*F41H 5/04* (2006.01)

(52) U.S. Cl.
CPC ..... *E05G 1/026* (2013.01); *F41H 5/0457* (2013.01); *F41H 5/0471* (2013.01)

(58) Field of Classification Search
CPC ..... E06B 2003/703; E06B 2003/7051; E06B 3/70; E06B 3/7015; E06B 5/10; E06B 5/12; F41H 5/0457; F41H 5/04; F41H 5/0442; F41H 5/0471; F41H 5/24; E05G 1/026
See application file for complete search history.

(56) References Cited

U.S. PATENT DOCUMENTS

| | | | | |
|---|---|---|---|---|
| 3,815,312 | A * | 6/1974 | Lench | 52/784.13 |
| 4,381,716 | A * | 5/1983 | Hastings et al. | 109/2 |
| 4,470,357 | A * | 9/1984 | Sanzaro | 109/84 |
| 4,567,100 | A * | 1/1986 | Pickett et al. | 428/339 |
| 5,469,796 | A * | 11/1995 | Koenig | 109/49.5 |
| 2003/0080248 | A1* | 5/2003 | Morgan | 244/118.5 |
| 2004/0163571 | A1* | 8/2004 | Fortin | 106/605 |
| 2007/0193220 | A1* | 8/2007 | Daniels | 52/784.11 |
| 2008/0092731 | A1* | 4/2008 | Hall | 89/36.04 |
| 2008/0289547 | A1* | 11/2008 | Wakamatsu et al. | 109/76 |
| 2010/0297388 | A1* | 11/2010 | Dagher et al. | 428/116 |
| 2011/0239851 | A1* | 10/2011 | Mason et al. | 89/36.02 |
| 2012/0167371 | A1* | 7/2012 | Mateu Climent | 29/428 |
| 2013/0133261 | A1* | 5/2013 | Choi | 49/9 |
| 2014/0000194 | A1* | 1/2014 | Daniels et al. | 52/232 |

* cited by examiner

*Primary Examiner* — Christine T Cajilig
(74) *Attorney, Agent, or Firm* — Ruder Ware, L.L.S.C.; Derek L. Prestin

(57) ABSTRACT

A security door that impedes or resists the penetration of bullets or other projectiles is provided, which may be used to protect the occupants in a room from threats outside the room by providing a bullet resistant entry door for the room. The preferred embodiment of the bullet resistant security door includes a threat-side outer surface or layer, a first core layer, bullet resistant ballistic layer, a second core layer, an armor layer, and a safe side outer surface or layer and is sufficient to meet the requirements of the Level 3 Protection Level of the UL 752 standard.

8 Claims, 4 Drawing Sheets

BULLET RESISTANT SECURITY DOOR

CROSS-REFERENCE TO RELATED APPLICATION

This application is based upon and claims the benefit of U.S. Provisional Application Ser. No. 61/956,551, filed Jun. 11, 2013.

BACKGROUND OF THE INVENTION

The invention disclosed herein relates to a security door and, more specifically, a security door that impedes or resists the penetration of bullets or other similar projectiles. The present invention provides a bullet resistant door which may be used to protect the occupants in a safe room from external threats by providing a bullet resistant entry door for the room.

In recent years, there have been incidents involving loss of life where an individual or individuals armed with guns have entered buildings such as malls and other commercial buildings, government offices, hospitals, and schools and universities, killing people in those locations, including those hiding in different rooms. Likewise, the owners of residences in certain unsafe areas or owners that are at greater risk of facing armed individuals in their residence, such as prosecutors, government officials, and individuals in the public eye, have installed so-called "safe rooms" at an increasing frequency.

As a result, there is an increasing need for bullet resistant security doors that can be used to create secure rooms in places such as malls and other commercial buildings, government offices, hospitals, and schools and universities and to act as the entry door for safe rooms in residences.

Current bullet resistant doors are often heavy, requiring special door frames to hold the doors and making the door more difficult to open and close. Since special door frames are often required, it is often either impossible or much more difficult and expensive to retrofit a building with bullet resistant security doors to replace pre-existing non-bullet resistant doors. Additionally, due to the heavier construction of the door, current bullet resistant doors are often expensive and more difficult to manufacture.

Likewise, while some lighter-weight doors have been produced, using a bullet resistant fiberglass in conjunction with layers of structural composite lumber, such prior art doors have been unable to pass certain desirable certifications, most notably certifications from UL for protection levels. That is, these prior art doors are unable to pass the protection level certification tests of UL, namely the Level 3 Protection Level tests of the UL 752 standard.

Therefore, there is a need for a security door that is bullet resistant, yet is lighter weight, is easy to manufacture, and can be retrofitted onto existing doorframes.

BRIEF SUMMARY OF THE INVENTION

It is a feature of the present invention to provide a bullet resistant security door to be used to create secure rooms in places such as malls and other commercial buildings, government offices, hospitals, and schools and universities and to act as the entry door for safe rooms in residences.

The present invention aims to address at least some of the problems with prior art doors by providing a lighter-weight door that can be more easily used to retrofit existing buildings that do not yet have bullet resistant doors with bullet resistant doors to create secured rooms or areas that may be used as a shelter in the event of armed individuals entering the building.

Additionally, the preferred embodiment of the present invention is able to pass the Level 3 Protection Level standards of the UL 752 standard, something that prior art doors have currently been unable to do. Likewise, with changes to the thicknesses of certain layers of the present invention, a door manufacturer may use less material and still have a bullet resistant security door that meets the protection level standards of Level 1 or Level 2 of the UL 752 standard.

Thus, the present invention aims to provide a bullet resistant security door that provides a quick, easy, and inexpensive way to create secured rooms or areas to provide shelter in the event of an armed attack.

DETAILED DESCRIPTION OF THE PREFERRED EMBODIMENT(S)

Embodiments of the present invention provide a security door that impedes or resists the penetration of bullets or other similar projectiles which may be used to protect the occupants in a room from external threats by providing a bullet resistant entry door for the room.

Figure 1:
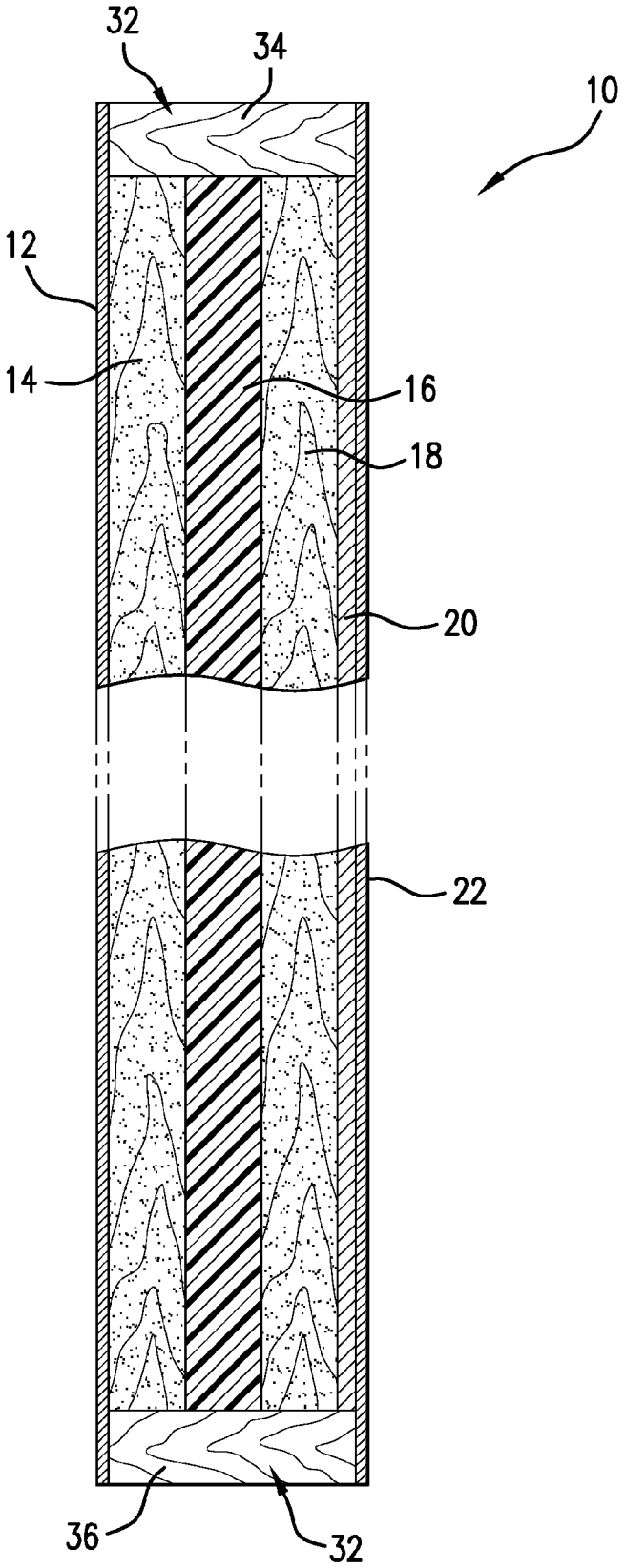
FIG. 1 is a vertical cross sectional view of one embodiment of the bullet resistant security door of the present invention.
Figure 2:
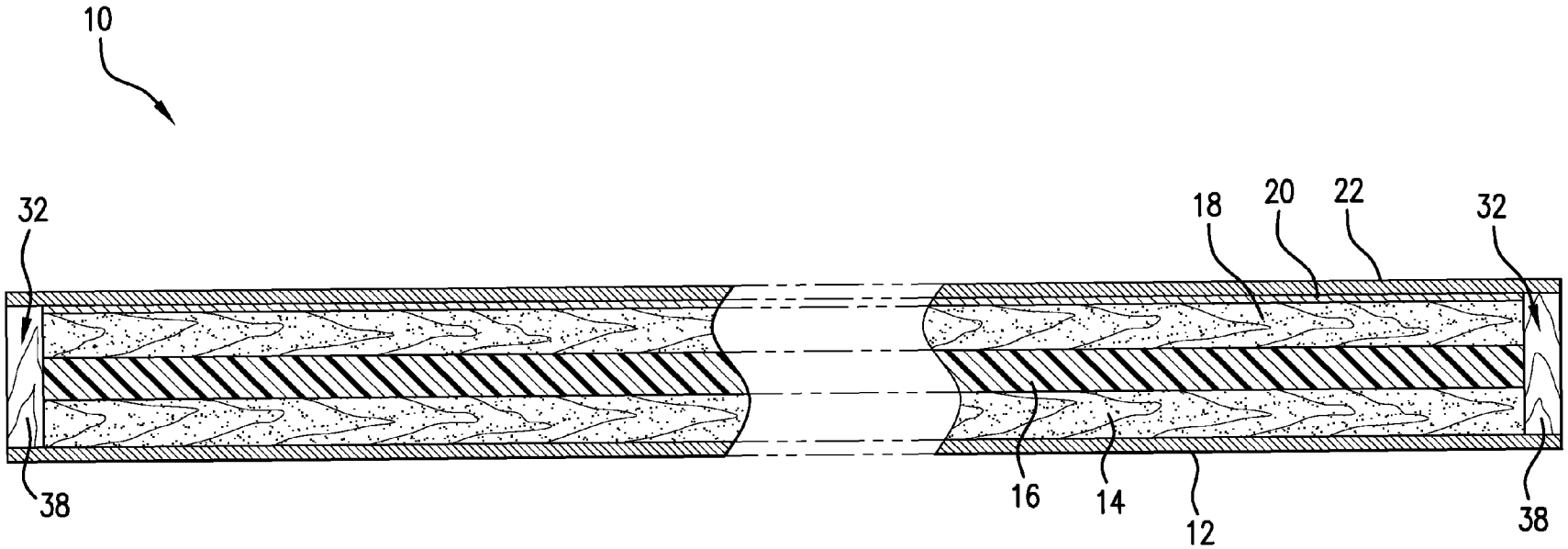
FIG. 2 is a horizontal cross sectional view of the bullet resistant security door of FIG. 1.
Figure 3:
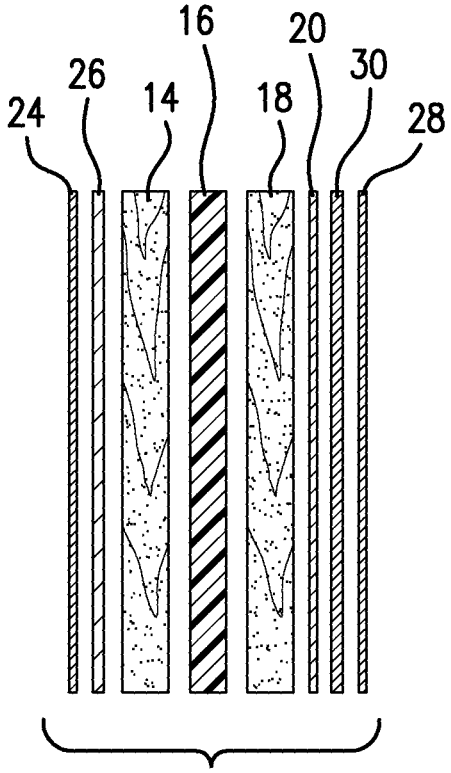
FIG. 3 is an exploded cross sectional view of the bullet resistant security door of FIG. 1.

Referring now FIGS. 1 and 2, the cross section of a preferred embodiment of the present invention is shown. This embodiment of the bullet resistant security door 10 of the present invention includes a threat-side outer surface or layer 12, a first core layer 14, bullet resistant ballistic layer 16, a second core layer 18, an armor layer 20, and a safe side outer surface or layer 22. An exploded cross sectional view of the present invention is shown in FIG. 3.

The threat side outer layer 12 covers the outer surface of the bullet resistant security door 10 on the side of the door that is intended to face the possible threat. The purpose of the threat side outer layer 12 is to provide an outer surface for the door that aesthetically matches with the surrounding door frame 100 and the rest of the structure in which the door is installed. In one embodiment of the present invention, the threat side outer layer 12 is a veneer 24 or high-pressure laminate material on high density fiberboard 26 cross-band material, comprising a veneer 24 and fiberboard 26, which provides a wood grain appearance. More preferably, the threat side outer layer 12 is a veneer 24 or high-pressure laminate material on high density fiberboard 26 cross-band material having a total thickness of approximately 0.110 inches.

The first core layer 14 and second core layer 18 provide the structural support for the door itself and for the mounting components (such as hinges 102), door handle 104, and lock for the door, as well as for the other layers of the door. In one embodiment of the present invention, the first core layer 14 and second core layer 18 are constructed of structural composite lumber or high density fiberboard. More preferably, the first core layer 14 and second core layer 18 are constructed of 0.510 inch structural composite lumber. Preferably, the first core layer 14 and second core layer 18 are located on either side of the bullet resistant ballistic layer 16, such that the bullet resistant ballistic layer 16 is sandwiched between the first core layer 14 and the second core layer 18. However, alternatively the first core layer 14 and second core layer 18 may be in different locations within the layers of the door; provided that a door having such an alternative configuration for the first core layer 14 and the second core layer 18 must be further tested to ensure that the modified design still meets the desired UL 752 standard. Likewise, while preferably the bullet resistant security door 10 includes both the first core layer 14 and the second core layer 18, alternatively, the second core layer 18 may be omitted and the bullet resistant security door 10 may include only a the first core layer 14 in cases where the second core layer 18 is not necessary or is not desired. For example, if the thickness of the bullet resistant ballistic layer 16 will be increased to increase the stopping power of the bullet resistant security door 10 the second core layer 18 may be omitted to allow the increased thickness of the bullet resistant ballistic layer 16 without increasing the overall thickness of the door. However, if the second core layer 18 of the door is omitted, the door must be further tested to ensure that the modified design still meets the desired UL 752 standard.

The bullet resistant ballistic layer 16 of the bullet resistant security door 10 is constructed of a bullet resistant ballistic material. In one embodiment of the present invention, the bullet resistant ballistic layer 16 is constructed of a bullet resistant fiberglass. More preferably, the bullet resistant ballistic layer 16 is constructed of a 0.4375 inch bullet resistant fiberglass. The bullet resistant fiberglass of the bullet resistant ballistic layer 16 may be any bullet resistant fiberglass known in the art and may be obtained from a variety of manufacturers known in the art, such as ArmorCore bullet resistant fiberglass from Waco Composites, Ltd.

The armor layer 20 of the bullet resistant security door 10 is constructed of a high strength metallic material. In one embodiment of the present invention, the armor layer 20 is constructed of steel. More preferably, the armor layer 20 is constructed of a 16 gauge steel sheet. However, any high strength metallic material known in the art with sufficient strength and thickness able to absorb any remaining kinetic energy of a bullet if a bullet penetrates the bullet resistant ballistic layer 16 may be used.

The safe side outer layer 22 covers the outer surface of the bullet resistant security door 10 on the side of the door that is intended to face the interior of the secured room or area, opposite the possible threat. The purpose of the safe side outer layer 22 is to provide an outer surface for the door that aesthetically matches with the surrounding door frame 100 and the rest of the structure in which the door is installed. In one embodiment of the present invention, the safe side outer layer 22 is a veneer 28 or high-pressure laminate material on high density fiberboard 30 cross-band material, comprising a veneer and fiberboard, which provides a wood grain appearance. More preferably, the safe side outer layer 22 is constructed of a veneer 28 or high-pressure laminate material on high density fiberboard 30 cross-band material having a total thickness of approximately 0.110 inches.

Preferably, both the threat side outer surface or layer 12 and the safe side outer surface or layer 22, as well as the outer surfaces of the first core layer 14 and the second core layer 18, have flat surfaces to allow for easy manufacturing and production. This also allows both sides of the door to have a similar look. However, alternatively, the threat side outer surface or layer 22 and the first core layer 14 may have a design that is not flat and instead incorporates any door outer surface design known in the art in order to provide a door surface that is more aesthetically pleasing and that corresponds with the designs of any standard door known in the art. However, if the outer surface of the door is not flat, the door must be further tested to ensure that the surface design does not comprise the bullet resistance of the door.

Additionally, while the preferred embodiment of the present invention includes the threat side outer surface or layer 12 and the safe side outer surface or layer 22, these layers may be omitted if a hardwood is used for the first core layer 14 and second core layer 18 in place of a structural composite lumber or high density fiberboard 30. However, where the threat side outer surface or layer 12 and the safe side outer surface or layer 22 are omitted, the door must be further tested to ensure that the modified design still meets the desired UL 752 standard.

The bullet resistant security door 10 also includes an outer frame 32 that includes a top rail 34, a bottom rail 3$, and two edge stiles 38. The outer frame 32 provides the mounting framework for the inner layers of the bullet resistant security door 10 and also provides the surface that will be adjacent to the door frame 100 in which the door will be mounted. In one embodiment of the present invention, the top rail 34, bottom rail 36, and edge stiles 38 are constructed from hardwood. More preferably, the top rail 34, bottom rail 36, and edge stiles 38 are constructed of ⅜ inch veneer hardwood.

The bullet resistant security door 10 of the present invention also includes mounting holes for the door handle 104, door lock, door latch, and any related mounting hardware known in the art. The mounting holes may have any size and configuration known in the art for any handles 104, locks, and latches known in the art.

Preferably, the overall thickness of the bullet resistant security door 10 of the present invention is approximately 1.75 inches, such that it matches the standard thickness of regular doors used in places such as malls and other commercial buildings, government offices, hospitals, and schools and universities. However, if different thicknesses of doors may be used with a particular type or size of door frame 100 or door, the thicknesses of the various layers of the bullet resistant security door 10 of the present invention may be varied in such a way that the overall thickness of the door is different than 1.75 inches.

While certain thicknesses of the various layers of the bullet resistant security door 10 are discussed herein in connection with the preferred embodiment, which is intended to satisfy the requirements of Level 3 Protection Level of the UL 752 standard, the thicknesses may be varied to create doors having different levels of protection under the UL 752 standard or other applicable standards. For example, the following layer thicknesses may be used:

TABLE 1

Dimensions of Layers of Door of Various Protection Levels.

| Component | Level 1 Protection | Level 2 Protection | Level 3 Protection |
|---|---|---|---|
| Ballistic Layer | 0.25 | 0.3125 | 0.4375 |
| Armor Layer | 0.0625 | 0.0625 | 0.0625 |
| 1st Core | 0.620 | 0.585 | 0.525 |
| 2nd Core | 0.620 | 0.585 | 0.525 |
| Total Core Assembly | 1.553 | 1.545 | 1.550 |
| Sanding of Core | (0.048) | (0.040) | (0.045) |
| Sanded Core | 1.505 | 1.505 | 1.505 |
| Threat Side Surface | 0.110 | 0.110 | 0.110 |
| Safe Side Surface | 0.110 | 0.110 | 0.110 |
| Total Thickness | 1.725 | 1.725 | 1.725 |

The protection levels set forth herein correspond with the Protection Levels under the UL 752 standard. Namely, under the current UL 752 standard, a protection level of Level 1 will protect against handguns of medium power (such as handguns firing 9 mm full metal copper jacket with lead core ammunition or handguns having a muzzle energy of 380-460 foot pounds or 515-624 J), Level 2 will protect against handguns of high power (such as handguns firing 0.357 magnum jacket lead soft point ammunition or handguns having a muzzle energy of 548-663 foot pounds or 743-899 J), and Level 3 will protect against handguns of super power (such as handguns firing 0.4 magnum lead semi-wadcutter gas checked ammunition or having a muzzle energy of 971-1,175 foot pounds or 1,317-1,593 J), While the embodiment of the present invention discussed herein is designed to meet the Level 3 UL 752 standard, it will be recognized by one skilled in the art that one could produce a security door meeting higher protection levels by varying the thicknesses of the layers of the bullet resistant security door 10, namely by increasing the thickness of the bullet resistant ballistic layer 16 and armor layer 20 and reducing the thickness of the first core layer 14 and/or the second core layer 18.

The outer dimensions of the bullet resistant security door 10 of the present invention, once the door is assembled, is selected to correspond with the dimensions of the standard door that it will be replacing or the dimensions of the door frame 100 in which it will be mounted. Generally, this will mean that the bullet resistant security door 10 will have dimensions that are the same as standard doors. However, the outer dimensions of the bullet resistant security door 10 of the present invention may be varied to allow the door to fit in any door frame 100 known in the art and to replace any sized door known in the art.

The bullet resistant security door 10 of the present invention is constructed by configuring and adhering the various layers of the door together. Once the desired protection level of the bullet resistant security door 10 has been decided upon, the required thickness of the bullet resistant ballistic layer 16 is determined and the bullet resistant ballistic layer 16 is ordered or manufactured. The outer dimensions of the bullet resistant ballistic layer 16 must be slightly smaller than the overall outer dimensions of the door, to allow for the installation of the top rail 34, bottom rail 36, and stile edges 38. For example, when ⅜ inch thick hardwood is used for the top rail 34, bottom rail 36, and stile edges 38, the outer dimensions of the bullet resistant ballistic layer 16 must be 0.75 inch narrower and 0.75 inch shorter than the pre-fit door size. The handle 104 and lock block and latch positions must also be determined based upon the end-user's order or the standard location for the handle 104 and lock block and latch for the standard door that the bullet resistant security door 10 is intended to replace or the location of the latch and lock receivers in the door frame 100 which the door will be used in. Mounting holes for the handle 104 and lock block and latch are then added to the bullet resistant ballistic layer 16.

Once the outer dimensions of the bullet resistant ballistic layer 16 have been determined, an armored layer 20 having the same dimensions is ordered or manufactured. Similarly, the location of the mounting holes for the handle 104 and lock block and latch are also added to correspond to the mounting holes for the handle 104 and lock block and latch in the bullet resistant ballistic layer 16.

Two sheets of the material for the first core layer 14 and second core layer 18 are then cut to the same outer dimensions of the bullet resistant ballistic layer 16 and the armor layer 20 and sanded to the appropriate thickness based upon the level of protection for the door and the desired overall thickness of the bullet resistant security door 10. For example, for a bullet resistant security door 10 intended to satisfy the requirements of Level 3 Protection Levels of the UL 752 standard, each core layer will be sanded to a thickness of 0.525 inches. The location of the mounting holes for the handle 104 and lock block and latch are also added to correspond to the mounting holes for the handle 104 and lock block and latch in the bullet resistant ballistic layer 16 and the armor layer 20.

Both sides of both the bullet resistant ballistic layer 16 and armor layer 20 are then cleaned to provide a clean surface for adhesives. For example, acetone may be used as the cleaning agent to clean the surfaces of the bullet resistant ballistic layer 16 and armor layer 20.

An adhesive is then added to both sides of the bullet resistant ballistic layer 16 and one side of the armor layer 20 and the first core layer 14, bullet resistant ballistic layer 16, second core layer 18 and armor layer 20 are cold pressed to secure the layers together to form the core assembly. Any adhesive known in the art may be used and any press time and cure time known in the art that is sufficient to fully secure the layers together may be used. For example, in the preferred embodiment of the present invention, R-416-3 polyvinyl acetate adhesive from IFS Industries, Inc. is used as the adhesive and a 45 minute press time and a 16 hour cure time is used.

While the first core layer 14, bullet resistant ballistic layer 16, second core layer 18 and armor layer 18 are being adhered together to form the core assembly, the top rail 34, bottom rail 36, and edge stiles 38 of the appropriate sizes are manufactured and cut to the required lengths. Once the adhesive in the core assembly has cured, the top rail 34, bottom rail 36, and edge stiles 38 are clamped and glued to the core assembly. Any glue or similar adhesive known in the art may be used. Generally, as the glue cures, the assembly must be laid with the armor layer 20 on the bottom against a flat surface to keep the top rail 34, bottom rail 36, and edge stiles 38 aligned with the surface of the armor layer 20.

The first core layer 14 and the edges of the top rail 34, bottom rail 36, and edge stiles 38 on the first core layer 14 side of the assembly are then sanded to make the top rail 34, bottom rail 36, and edge stiles 38 flush with the outer surface of the first core layer 14. The sanding of the first core layer 14 and the edges of the top rail 34, bottom rail 36, and edge stiles 38 on the first core layer 14 side of the assembly until the desired overall thickness for the core assembly is reached. For example, in one preferred embodiment of the present invention, the sanding of the first core layer 14 and the edges of the top rail 34, bottom rail 36, and edge stiles 38 is continued until the core assembly has an overall thickness of 1.505 inches.

Once the core assembly and outer frame 32 have been sanded to the desired overall thickness, the threat side outer surface or layer 12 and the safe side outer surface or layer 22 are adhered to the opposite outer surfaces of the core assembly and outer frame 32. An adhesive is added to both sides of the core assembly and outer frame 32 assembly and the core assembly and outer frame 32 assembly and threat side outer surface or layer 12 and the safe side outer surface or layer 22 are cold pressed to secure them together to form the bullet resistant security door 10. Any adhesive known in the art may be used and any press time and cure time known in the art that is sufficient to fully secure the core assembly and outer frame 32 assembly and the core assembly and outer frame 32 assembly and threat side outer surface or layer 12 and the safe side outer surface or layer 22 together may be used. For example, in the preferred embodiment of the present invention, R-416-3 polyvinyl acetate adhesive from IFS Industries, Inc. is used as the adhesive and a 45 minute press time is used.

Once the threat side outer surface or layer 12 and the safe side outer surface or layer 22 has been adhered to the core assembly and outer frame 32 assembly, the edges of the bullet resistant security door 10 are routered to make the threat side outer surface or layer 12 and the safe side outer surface or layer 22 flush with the core assembly and outer frame 32 assembly.

Finally, the bullet resistant security door 10 is trimmed to its final desired length and width using a hand router.

In general, the handle 104, lock, and latch are installed within the mounting holes in the door in the field when the door is installed within a building. However, alternatively, once the bullet resistant security door 10 is fully assembled, the handle 104, lock, and latch are installed within the mounting holes in the door.

Figure 4:
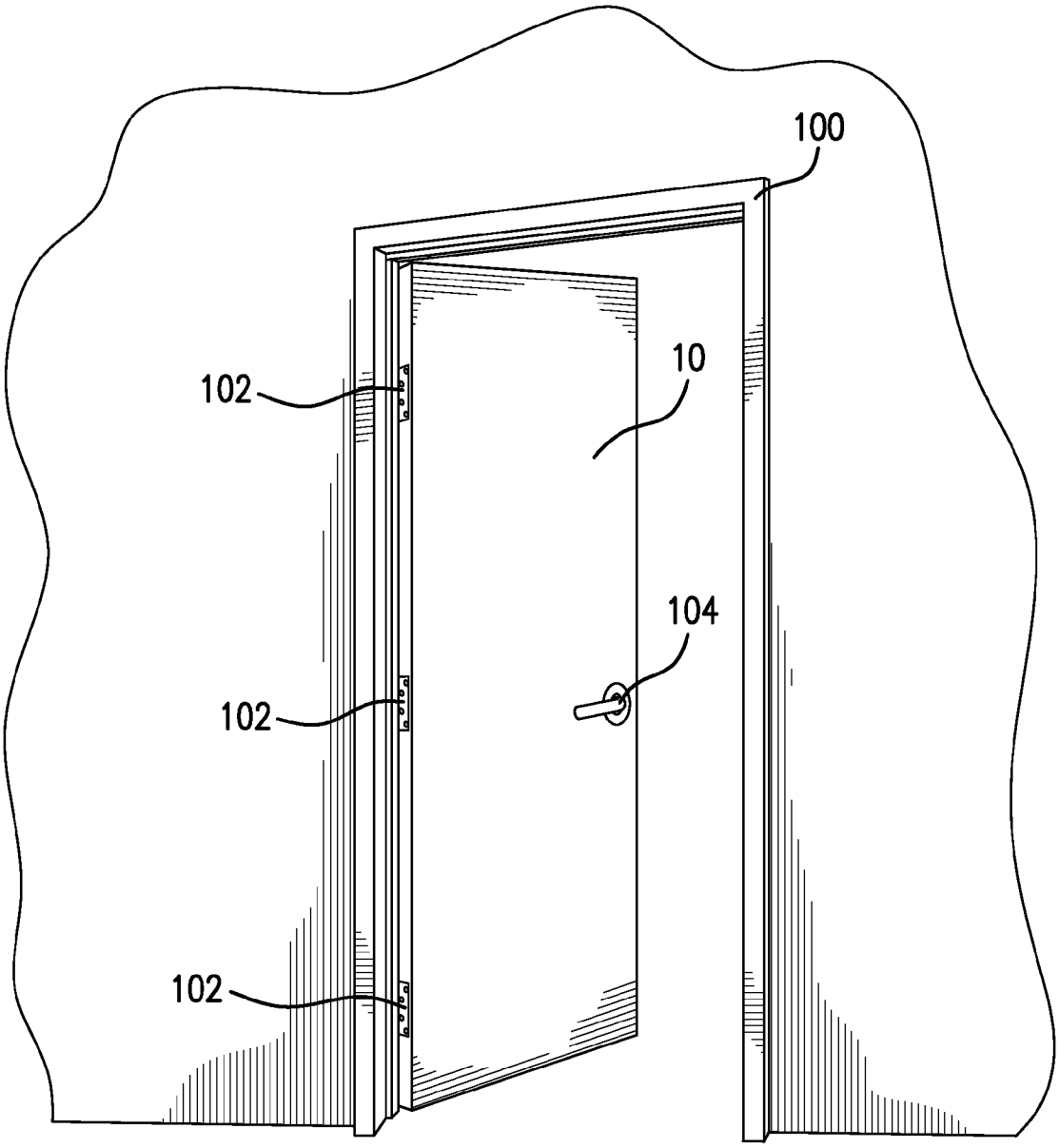
FIG. 4 is a perspective view of the bullet resistant security door of FIG. 1 mounted in a standard door frame.

As best shown in FIG. 4, the door can then be mounted in the desired door frame 100, or replace an existing standard door when applicable, using standard methods and components, such as hinges 102, known in the art. When the door is installed, the threat side outer surface 12 faces the direction of the possible threat while the safe side outer surface 22 faces the interior of the secure room or area where individuals would be able to hide and shield themselves from the possible threat. That is, the outer surface of the bullet resistant security door 10 that is adjacent to the armor layer 20 should face the "safe" area and away from the potential threat, such that any bullet or projectile fired into the door must penetrate the bullet resistant ballistic layer 16 before coming into contact with the armor layer 20.

The bullet resistant security door 10 of the present invention may be used in any location where any type of door, whether interior or exterior, is currently used. The bullet resistant security door 10 may be installed in the place of such standard types of doors, or may replace such doors if the bullet resistant security door 10 is being added as part of the retrofitting of an existing building. For example, the bullet resistant security door 10 of the present invention may be used in commercial buildings, hospitals, schools, and government buildings, as well as part of informal safe rooms in residences and other similar places.

It will be recognized by one skilled in the art that the size, configuration, or dimensions of the bullet resistant security door of the present invention may be adjusted to be used with a variety of different sizes and configurations of door frames. Likewise, it will be recognized by one skilled in the art that the size, dimensions, and thicknesses of the layers of the bullet resistant security door of the present invention may be varied to meet the requirements of an end-user in terms of desired bullet resistance. That is, where the end user desires a lower level of bullet resistance, the layers of the bullet resistant security door of the present invention, namely the bullet resistant fiberglass and armor layers, may be reduced in thickness, while where the end user desires a higher level of bullet resistance, the layers of the bullet resistant security door of the present invention, namely the bullet resistant fiberglass and armor layers, may be increased in thickness. Additionally, it will be recognized by one skilled in the art that the order or configuration of the layers of the bullet resistant security door in the embodiment of the present invention shown and described herein may be varied without affecting the bullet resistance of the door and therefore such changes would fall within the scope of the present invention. However, if the door design has an alternative size or configuration, the door must be further tested to ensure that the door still meets the desired UL 752 standard.

While the invention, has been described in the specification and illustrated in the drawings with reference to certain preferred embodiments, it will be understood by those skilled in the art that various changes may be made and equivalents may be substituted for elements thereof without departing from the scope of the present invention as defined in the appended claims. In addition, many modifications may be made to adapt a particular situation or material to the teachings of the invention, as defined in the appended claims, without departing from the essential scope thereof. Therefore, it is intended that the present invention not be limited to the particular embodiments illustrated by the drawings and described in the specification as the best modes presently contemplated for carrying out the present invention, but that the present invention will include any embodiments falling within the description of the appended claims.

What is claimed is:

1. A security door comprising in order of sequence from a threat side to a safe side of the door:

a threat-side outer surface comprising wood veneer;

a first core layer comprising structural composite lumber, wherein the first core layer is adhered to the threat-side outer surface with an adhesive;

a bullet resistant ballistic layer, wherein the bullet resistant ballistic layer is adhered to the first core layer with an adhesive;

a second core layer comprising structural composite lumber, wherein the second core layer is adhered to the bullet resistant layer with an adhesive;

an armor layer, wherein the armor layer is adhered to the second core layer with an adhesive; and a safe-side outer surface comprising wood veneer, wherein the safe-side outer surface is adhered to the armor layer with an adhesive.

2. The security door of claim 1, wherein the first core layer and the second core layer comprise high density fiberboard.

3. The security door of claim 1, wherein the bullet resistant ballistic layer comprises bullet resistant fiberglass.

4. The security door of claim 1, wherein the armor layer comprises a high strength metal.

5. The security door of claim 4, wherein the armor layer comprises steel.

6. The security door of claim 5, wherein the armor layer comprises a 16 gauge steel sheet.

7. The security door of claim 1, further comprising an outer frame, wherein the outer frame comprises a top rail, a bottom rail, and two stile edges.

8. The security door of claim 7, wherein the top rail, bottom rail, and stile edges comprise hardwood.

* * * * *